US007552737B2

(12) United States Patent
Ghaemaghami Rad

(10) Patent No.: US 7,552,737 B2
(45) Date of Patent: Jun. 30, 2009

(54) WATERLESS CARWASH LIQUID COMPOSITION AND METHOD FOR PRODUCING THE SAME

(76) Inventor: Shahram Ghaemaghami Rad, Shahrak Gharb, Farahzadi, Taherkhani, Parastoo, #20, Tehran (IR)

( * ) Notice: Subject to any disclaimer, the term of this patent is extended or adjusted under 35 U.S.C. 154(b) by 0 days.

(21) Appl. No.: 12/040,873

(22) Filed: Mar. 1, 2008

(65) Prior Publication Data

US 2008/0318827 A1 Dec. 25, 2008

(51) Int. Cl.

| | |
|---|---|
| ***B08B 3/04*** | (2006.01) |
| ***C11D 1/12*** | (2006.01) |
| ***C11D 3/18*** | (2006.01) |
| ***C11D 3/20*** | (2006.01) |
| ***C11D 3/43*** | (2006.01) |

(52) U.S. Cl. ..... 134/25.1; 134/39; 134/41; 134/42; 510/241; 510/243; 510/244; 510/251; 510/256; 510/271; 510/273; 510/426

(58) Field of Classification Search ..... 510/241, 510/243, 244, 251, 256, 271, 273, 426; 134/25.1, 134/39, 41, 42

See application file for complete search history.

(56) References Cited

U.S. PATENT DOCUMENTS 4,710,371 A * 12/1987 Palinczar ..... 424/47

OTHER PUBLICATIONS

"Toxaphene" literature from http://en.wikipedia.org/wiki/Toxaphene, pp. 1-2, Aug. 5, 2008.*

* cited by examiner

*Primary Examiner*—Brian P Mruk
(74) *Attorney, Agent, or Firm*—Idesazane Aryan; Barry ChooBin

(57) ABSTRACT

The present invention is a substantially nonabrasive, liquid car cleaner composition which cleans car surfaces without an external source of water to wash or rinse. The liquid cleaner is a composition of up to toxaphene 15%, sodium lauryl sulfate 10%, paraffin 10%, isopropyl alcohol 15%, and water 50%.

3 Claims, No Drawings

WATERLESS CARWASH LIQUID COMPOSITION AND METHOD FOR PRODUCING THE SAME

SPONSORSHIP

The present invention was sponsored in part by the Iranian National Science Foundation.

FIELD OF THE INVENTION

The present invention relates to a cleaning composition. More specifically, the present invention relates to car wash compositions and more specific still, car wash compositions which do no require dilution into larger quantities of water, which cleans car surfaces without an external source of water to wash or rinse, but which may be sprayed directly onto a vehicle.

An automobile, or other vehicle, represents a considerable expense, both the purchase or lease of the vehicle and its maintenance. However, despite rising sticker prices, luxury and sports automobiles continue to be sought after. The prestige of driving an attractive car endures monetary inhibitions.

Because of the large monetary expenditure created by vehicles, many owners or uses rely on routine cleaning and maintenance to maximize their enjoyment, as well as the life and beauty of their car. Cleaning and detailing a vehicle instantly improves its appearance. A shining exterior conveys a sense of luxury and pride for all to see. Whether luxury or economy, a car with a freshly cleaned body and spotless windows is to be admired.

Unfortunately, washing a vehicle such as a car, truck, SUV or van, is a time-consuming and labor-intensive endeavor. Additionally, having a vehicle washed by a professional, is a money-intensive endeavor. Because many owners cannot afford a professional washing regularly, many owners wash the vehicle themselves. Other owners enjoy the act of washing the vehicle themselves.

Hand washing a vehicle typically involves wetting the vehicle surface with a hose, such the garden hose, applying a washing detergent to the vehicle surface, and then rinsing the surface with the hose. Those more dedicated owners usually towel dry the vehicle surface. For most consumers, especially the 'backyard variety', the washing detergent is obtained by placing an amount of concentrated detergent in a bucket and adding water to the bucket from the garden hose or other residential source, such as a kitchen sink.

For many households, the water in the garden hose, and possibly the kitchen sink, is hard water, having a hardness of at least 1 grain and often of at least 5 grain. This hard water wrecks havoc on many commercially available car wash detergents, causing a precipitate to form in the bucket. Most consumers do not realize that the cloudy solution in their wash bucket is an undesired by-product caused by the reaction of the water with the detergent. Cold water is particularly hostile at forming the precipitate.

Many types of car wash compositions are commercially available in the marketplace. These car wash compositions typically include detergents and surfactants and have been known to include polymers to render a surface more hydrophilic.

These conventional car washes function by lifting dirt away from the surface, suspending as much as possible in the car wash/water mixture, and removing the dirt from the washed vehicle as a water rinse is applied. Additional wiping with a terry cloth or chamois is often required to attempt to remove the dirt that fell out of suspension or that was never suspended initially.

The hardness of the water can also affect the effectiveness of the car wash composition. Excessive concentrations of calcium, magnesium and other minerals can form water spots as beads of water dry on the surface of the vehicle. This will often require additional wiping of the car surface to remove these unsightly deposits.

Wiping a car surface multiple times to remove dirt which fell out of suspension and to remove water spots can significantly impact the time required to wash a car. Areas of the car surface can also be overlooked upon wiping, thus dirt and water spots remain and dissatisfaction with the car wash composition can impact the consumer's choice as to their next purchase and harm the reputation of the manufacturer.

All cars have a finish: a combination of paint and clear sealant of some variety. Older cars have a finish that's mostly paint with a thin, glossy coat of lacquer over the paint. The finish on newer cars consists of a thin layer of paint with a much thicker lawyer of glossy clear coat applied on top of paint. And finally, some cars have a layer of protective wax that the owner applies. When a car is waxed, we are adding a layer that protects any kind of finish from the damaging effects of road grime, tree sap, bird droppings, dead insects and air pollution. The finish is the first line of defense against body rot, and for that reason one should keep it intact. Once the finish is impaired, more destructive types of corrosion will take place.

To avoid damaging the finish and wax, it is needed to wash and dry car with clean, soft all cotton towels, or car washing mitts. Using the wrong cloth during the washing or drying process can create scratches and swirls.

The same holds true for the cleaning solutions: dish washing liquid will strip the car wax right off the finish, and powdered soaps can scratch the clear coat.

Furthermore, waterless car care products of the prior art such as waxes and cleaners/polishes are instructed to be applied by implements such as cloth, terry towels, or smooth foam pads, and require prior cleaning of the surfaces to remove the soils.

Therefore, it would be advantageous to have a cleaning composition that would overcome the above shortcomings.

SUMMARY OF THE INVENTION

The present invention is a substantially nonabrasive, liquid car cleaner composition which cleans car surfaces without an external source of water to wash or rinse. The liquid cleaner is a composition of up to toxaphene 15%, sodium lauryl sulfate 10%, paraffin 10%, isopropyl alcohol 15%, and water 50%.

These substances should be turned into a thin liquid under particular circumstances: first of all paraffin is heated in a container at the above mentioned percentage. After the paraffin is completely converted to a liquid, and after 10 seconds, it is added to other substances and the mixture is poured into a mixer, and is fully mixed under speedy spin for 30 minutes. When the substance changes to a quit even and integrated liquid, it is poured in spray bottles and packed.

The liquid car cleaner is applied to car surfaces with any suitable applicator.

The present invention composition can be applied to all types of cars, buses, Vans, Station wagons, boats, jet skis, motorcycles, and other vehicles.

This novel composition produces significant reductions in water spotting and in the dispersion of soil and other constituents of dirt from the surface of vehicles when compared to commercially available car wash compositions. This composition also allows for the elimination of hand drying. The novel composition is particularly useful when pre diluted and applied directly to the car surface, thus eliminating the step of dilution and the need for a bucket.

DETAILED DESCRIPTION OF THE INVENTION

Manufacturing Process: The raw materials needed for its production are: toxaphene 15%—sodium lauryl sulfate 10%, paraffin 10%, isopropyl alcohol 15% and water 50%. These substances should be turned into a thin liquid under particular circumstances: first of all paraffin is heated in a container at the mentioned percentage. After the paraffin is completely converted to a liquid, and after 10 seconds, it is added to other substances and the mixture is poured into a mixer, and is fully mixed under speedy spin for 30 minutes. When the substance changes to a quit even and integrated liquid, it is poured in spray bottles and packed.

Method of use: The solution is poured inside the container (a bottle having a spraying pump) similar to glass washer sprays. First the car body is sprayed with it. Ten seconds later it is wiped smoothly with a soft and dry piece of cloth. This solution dissolves dust particles in it and doesn't cause any abrasion or scratch on the car body surface after being wiped by the cloth. It is used for washing all cars having metallic or normal colors and causes the color of the car to shine. Each liter of it is sufficient for washing three cars or one car for three times. Its application and carrying method is easy. It can be used by anybody on any condition and anywhere. Particularly it can be easily used in residential complexes and towers at the parking sites.

The present invention is intended to be diluted in an appropriate volume of water. De-mineralized water is preferred so that water spotting can be minimized, but is not required to reap the advantages of the novel composition. The present invention is stable enough to be prediluted in a spray bottle or other commonly utilized means for commercial packaging. The common step of diluting a car wash in a bucket or other sufficiently large container at the time of washing is not required with the present invention since the novel composition is so effective at suspending particulates that constant rinsing is not required.

Ideally the present invention is sprayed on to a vehicle surface. Application may be to the entire vehicle or to specific locations for spot cleaning. Upon wiping, the soil and other surface contaminants are loosened and agitated thus becoming suspended within the mixture of water and the novel composition. Nowadays when the problem of water shortage is becoming more and more serious, using this solution can be an effective factor in conserving this vital liquid. The main purpose of producing such a product is to save water, which as we go by every day in this world, we do see the shortage of the water becoming more serious problem in every day life. So we can always have a clean and shining car without using a drop of water.

The novel car wash composition of the present invention provides a significant reduction in water spotting from scale and redeposition of particulates. The present invention also keeps soil in suspension and in greater amounts than other compositions tested.

Application: All types of cars, buses, vans, station wagons, small boats, jet skis, motorcycles, and other vehicles.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

I claim:

1. A thin liquid cleaner composition for applying on a surface of a vehicle comprising of:

sodium lauryl sulfate 10% by weight of the composition, paraffin 10% by weight of the composition, isopropyl alcohol 15% by weight of the composition, and water 50% by weight of the composition, wherein said composition is applied to said surface of said vehicle.

2. A method of cleaning car painted and vinyl surfaces which comprises applying a thin liquid car cleaner to said surfaces with an appropriate applicator, wherein said thin liquid car cleaner comprises of: sodium lauryl sulfate 10% by weight of the composition, paraffin 10% by weight of the composition, isopropyl alcohol 15% by weight of the composition, and water 50% by weight of the composition, wherein said liquid car cleaner is applied to said surfaces.

3. A method for making a thin liquid cleaning composition for applying on a surface of a vehicle comprising steps of;

Heating paraffin 10% by weight of the composition;

Adding sodium lauryl sulfate 10% by weight of the composition, isopropyl alcohol 15% by weight of the composition, and water 50% by weight of the composition to said paraffin; and Mixing said composition, wherein said composition is applied to said surface of said vehicle.

* * * * *